US009180360B2

(12) United States Patent
De Lange

(10) Patent No.: US 9,180,360 B2
(45) Date of Patent: Nov. 10, 2015

(54) PIN-SETTING APPARATUS FOR BOWLING OR SKITTLE LANES

(75) Inventor: Cornelius De Lange, Berkel en Rodenrijs (NL)

(73) Assignee: BOWLING NEDERLAND B.V., Berkel en Rodenrijs ( * ) Notice: Subject to any disclaimer, the term of this patent is extended or adjusted under 35 U.S.C. 154(b) by 0 days.

(21) Appl. No.: 13/976,731

(22) PCT Filed: Oct. 28, 2011

(86) PCT No.: PCT/NL2011/050732

§ 371 (c)(1), (2), (4) Date: Sep. 16, 2013

(87) PCT Pub. No.: WO2012/091550

PCT Pub. Date: Jul. 5, 2012

(65) Prior Publication Data

US 2014/0004965 A1 Jan. 2, 2014

(30) Foreign Application Priority Data

Dec. 28, 2010 (NL) ..... 2005930

(51) Int. Cl.
*A63D 5/08* (2006.01)

(52) U.S. Cl.
CPC ..... *A63D 5/08* (2013.01); *A63D 2005/083* (2013.01)

(58) Field of Classification Search
CPC ..... A63D 5/08
USPC ..... 473/78–82
See application file for complete search history.

(56) References Cited

U.S. PATENT DOCUMENTS

| | | | | | |
|---|---|---|---|---|---|
| 3,073,596 | A | * | 1/1963 | Eyre | 473/81 |
| 3,090,619 | A | * | 5/1963 | Plant | 473/81 |
| 3,458,191 | A | | 7/1969 | Murdoch et al. | |
| 3,941,379 | A | * | 3/1976 | Paule et al. | 473/81 |
| 5,167,412 | A | * | 12/1992 | Rochefort | 473/78 |
| 5,429,554 | A | * | 7/1995 | Burkholder | 473/73 |

FOREIGN PATENT DOCUMENTS

| | | |
|---|---|---|
| DE | 24 18 173 | 11/1975 |
| WO | WO 00/66233 | 11/2000 |

OTHER PUBLICATIONS

International Search Report for PCT/NL2011/050732 mailed Jan. 9, 2012.

* cited by examiner

*Primary Examiner* — William Pierce
(74) *Attorney, Agent, or Firm* — Nixon & Vanderhye, P.C.

(57) ABSTRACT

The invention relates to a pin-setting apparatus for bowling or skittle lanes (3'-6') comprising a plurality of pins (3-6), wherein each pin is connected to an associated string (3'-6'). The apparatus comprises for each pin (3-6) a rotatable pulley (13-16) arranged to roll up and/or off the associated string (3'-6') and detecting means arranged to detect a movement of the pin (3-6) when hit directly or indirectly by a bowling ball, and activating means arranged to rotate the pulley (13-16) so as to roll off the string (3'-6') as soon as the pin (3-6) gets hit. This way, the pin (3-6) will not be obstructed by possible tension in the string (3'-6') and will move as if it was not attached at all.

7 Claims, 7 Drawing Sheets

PIN-SETTING APPARATUS FOR BOWLING OR SKITTLE LANES

This application is the U.S. national phase of International Application No. PCT/NL2011/050732 filed 28 Oct. 2011 which designated the U.S. and claims priority to NL 2005930 filed 28 Dec. 2010, the entire contents of each of which are hereby incorporated by reference.

The invention generally relates to skittle alleys and bowling lanes. The invention more particularly relates to a pin-setter for picking up and setting down the pins at the end of such a lane. Furthermore the invention relate to a method of controlling pins on a bowling or skittle lane.

Automated pin-setters for resetting pins are commonly used. Roughly, these pin-setters can be classified into two types, i.e. the stringless pin-setters and the string pin-setters. The present invention relates to the second type of pin-setters.

A well known problem of the string pin-setters is the influence the strings have on the freedom to move for the pins. Since the top of each pin is connected to a string, this string will slightly influence the trajectory of a pin once it is struck by a bowling ball. It is for this reason that only stringless pin-setters are used at professional bowling competitions.

It is the object of the present invention to provide a pin-setting apparatus wherein the influence of the strings on the pins when hit by a ball is decreased as compared to the known apparatus.

This object is achieved by providing a pin-setting apparatus for bowling lanes or skittle alleys comprising a plurality of pins, wherein each pin is connected to an associated string and the apparatus comprising for each pin:

a rotatable pulley arranged to roll up and/or off the associated string;

a detecting means arranged to detect a movement of the pin;

activating means arranged to rotate the pulley.

The apparatus further comprises a controller arranged to control the activating means in such a way that a particular string is actively rolled off as soon as the associated pin has been hit.

By using a pulley for each pin and actively rotate the pulleys so as to roll off the associated strings, the tension in the strings is minimized. This means that the influence of the strings on the movement of the pins is decreased as compared to apparatus that do not actively roll off the strings.

In an embodiment, the rotatable pulley comprises a wheel hub and an axis, wherein the activating means comprise an electrical motor having an axis that is coupled to the axis of the rotatable pulley. This results in a very simple and robust configuration of the pulleys.

According to a further embodiment the detecting means comprises an electrical circuit arranged to detect an induction current caused by a rotation of the pulley. This is a detection method having fast response times and causing no additional obstruction.

According to an embodiment, the apparatus comprises for each pin positioning means arranged to move the pulley above a determined pin position, so as to be able to reposition the pin in case of an off-spot situation.

Preferably the string is rolled off with a speed of between 0.25-2 meter per second. Other lengths are possible.

In a further embodiment, the controller is arranged to detect when some strings are entangled and to control the activating means of the entangled strings in such as way that the pins are lowered until a position wherein the pin does not touch the corresponding clock nor a pin deck of the apparatus. This results in a very good and fast disentangle process.

The invention also relates to a method of controlling pins on a bowling lane or skittle alley, wherein each of a plurality of pins is connected to an associated string, the method comprising:

rolling up and/or off the associated string using a separate rotatable pulley;

detecting a movement of each pin using detecting means;

rotating the pulley so as to actively roll off the associated string using the rotatable pulley.

Further details and advantages of the present invention will become clear to the reader after reading the description of the embodiments described below with reference to the accompanying drawings, in which.

Figure 1:
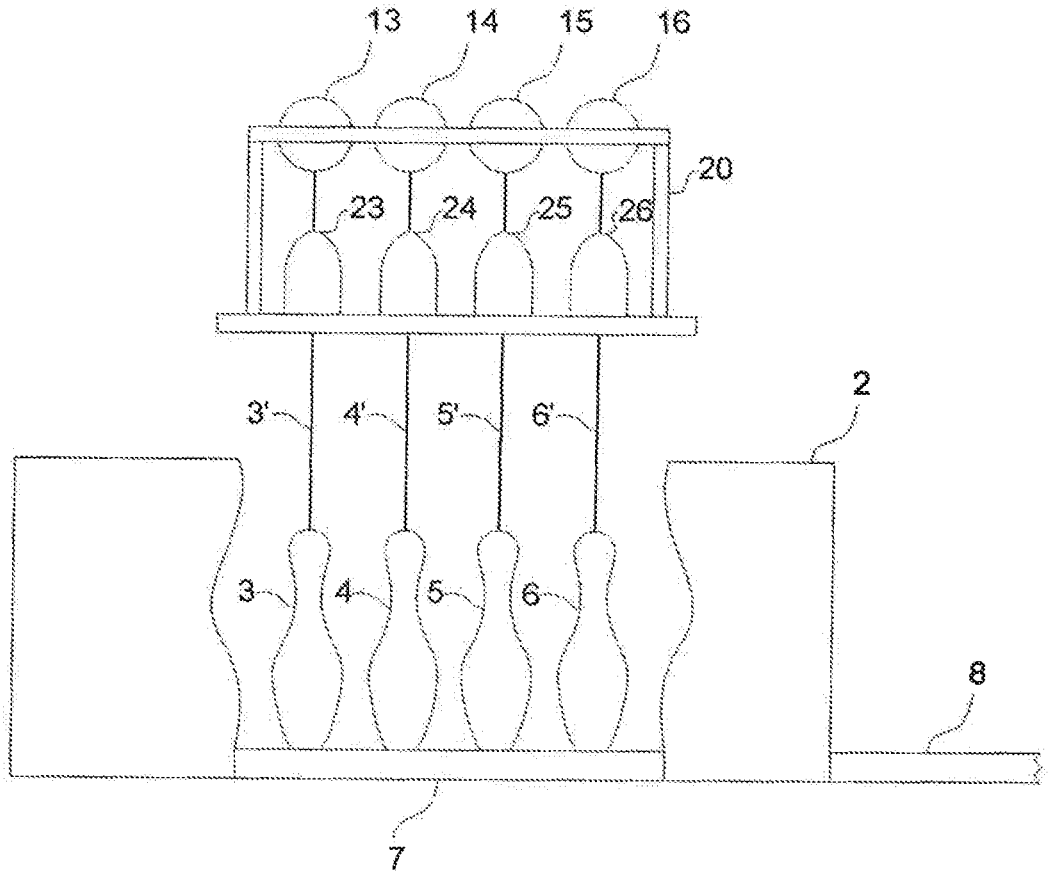
FIG. 1 shows a side view of part of a bowling lane and a pin-setting apparatus according to an embodiment of the invention.
Figure 2:
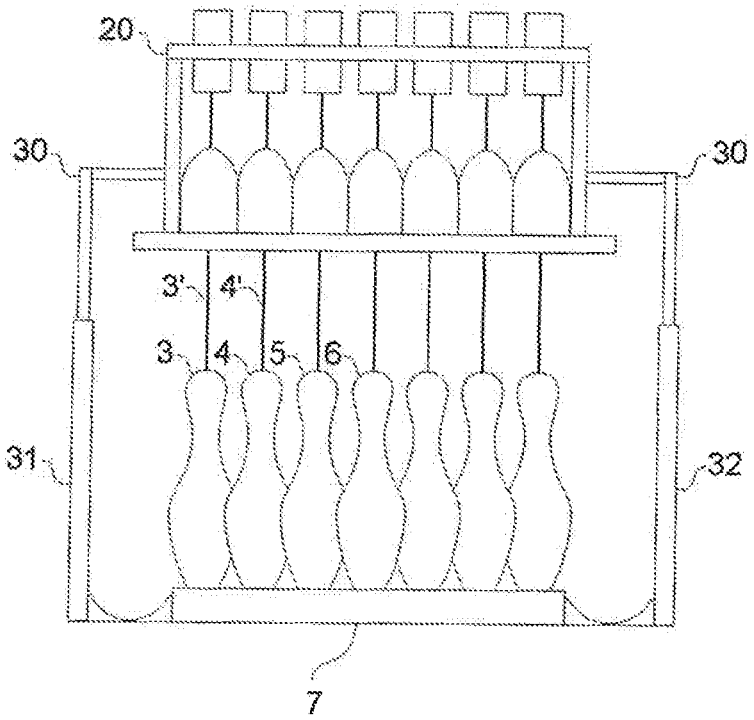
FIG. 2 shows a front view of the kickback and the pin-setting apparatus of the embodiment of FIG. 1.
Figure 3:
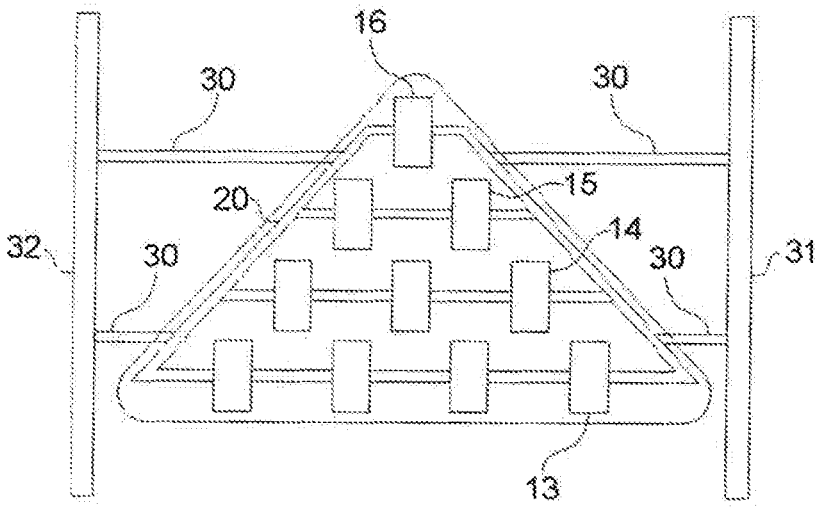
Figure 4:
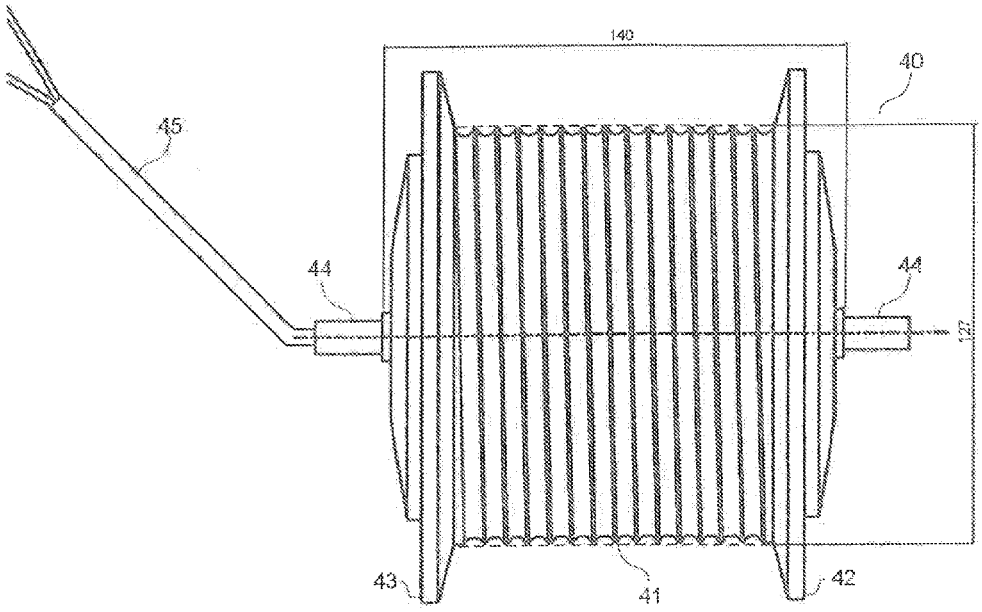
Figure 5:
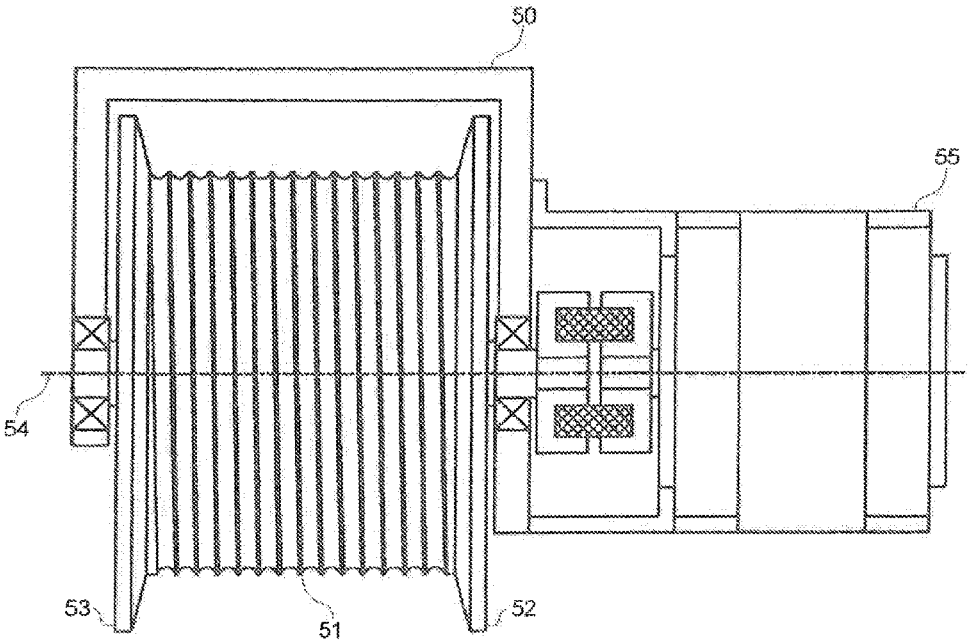
Figure 6:
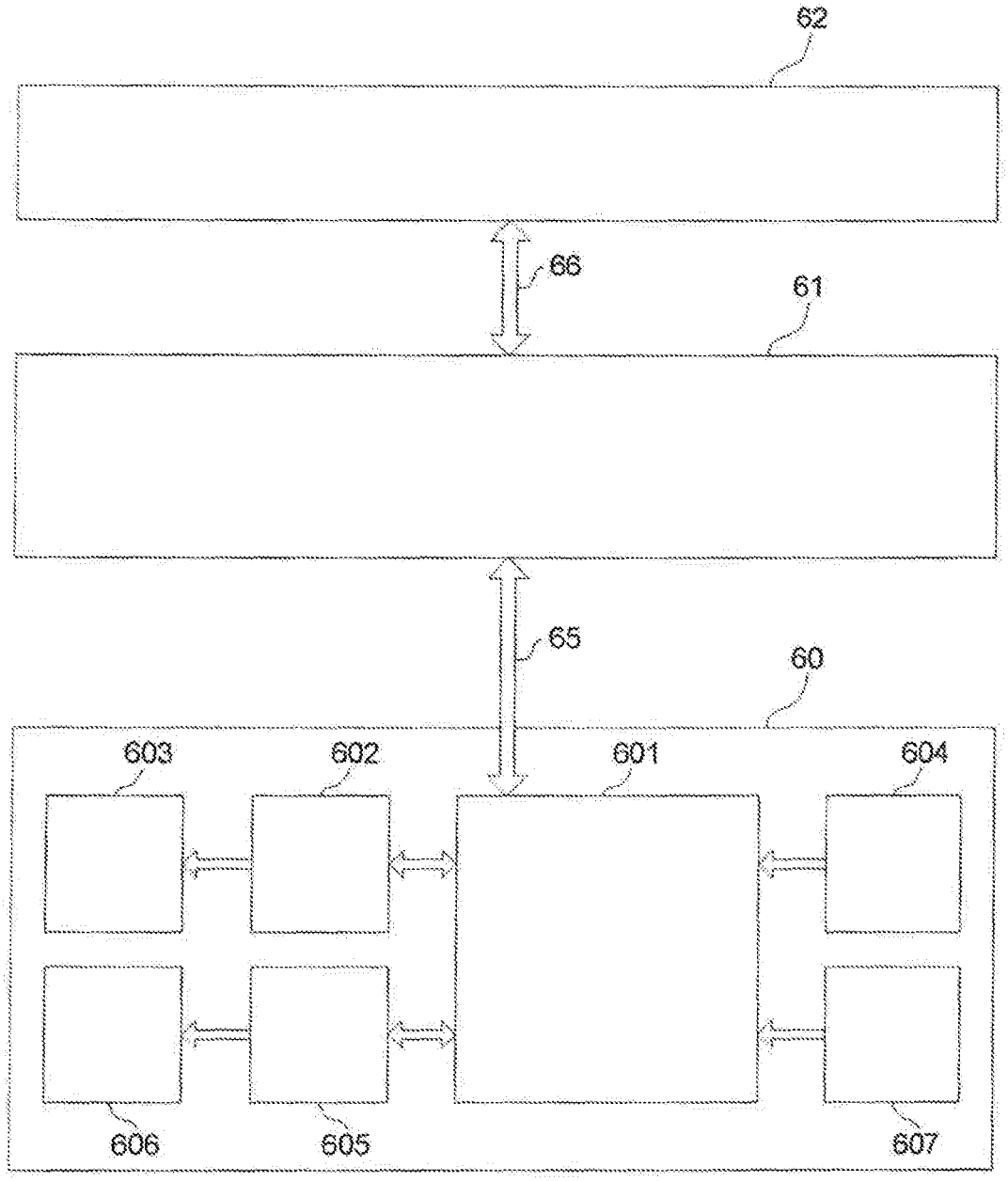
Figure 7:
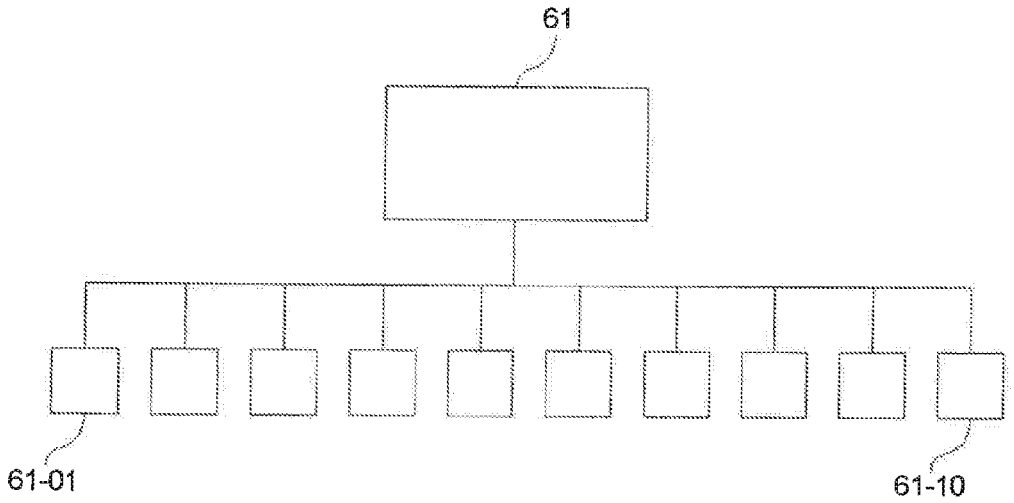

FIG. 3 schematically shows a top view of the embodiment of FIGS. 1 and 2;

FIG. 4 schematically shows a pulley which is used in a pin-setting apparatus according to an embodiment;

FIG. 5 schematically shows a further embodiment of the pulley;

FIG. 6 is a functional block diagram showing the main components of the pin-setting-apparatus according to an embodiment;

FIG. 7 shows the central controller connected to ten pulleys according to an embodiment.

FIG. 1 shows a side view of part of a bowling lane and a pin-setting apparatus 1 according to an embodiment of the invention. In FIG. 1, a kick back 2 is shown which is partly cut-out to show the pins, only four of them are visible in this side view, see pins 3, 4, 5, 6. The pins stand on a pin deck 7 which is at the end of a bowling lane 8. Each pin is connected to an associated string 3', 4', 5' and 6'. Above the pin deck 7 a pin-setting apparatus is arranged comprising a plurality of pulleys 13, 14, 15 and 16. The pulleys 13, 14, 15, 16 are arranged in a frame 20 in such a configuration that above each pin 3, 4, 5, 6 a pulley 13, 14, 15, 16 is positioned. The pin-setting apparatus also comprises a plurality of so-called clocks 23, 24, 25, 26 through which the respective strings 3', 4', 5', 6' are guided. For each pulley 13, 14, 15, 16 the apparatus 1 comprises an activator, not visible in FIG. 1, which is arranged to rotate a specific pulley. By rotating a pulley, the associated string can be rolled up and/or rolled off. In this way, the respective pins can be picked up and put down again.

FIG. 2 shows a front view of the kickback 2 and the pin-setting apparatus 1 of the embodiment of FIG. 1. As can be seen from FIG. 2, the frame 20 of the pin-setting apparatus 1 is supported by a suspension 30 which rests on side walls 31, 32 of the kickback 2. The total pin-setting apparatus 1 can easily be installed in an existing kick-back because it only needs to be positioned in the correct way on the walls 31, 32 of the kick back. Advantageously, no other arrangements need to be made to the existing bowling lane.

FIG. 3 schematically shows a top view of the embodiment of FIGS. 1 and 2. In this embodiment, the frame 20 is substantially triangular and comprises cross rods which support the pulleys. In this embodiment, ten pins are present and also ten pulleys. It should be noted that the invention is not limited to the use of ten pins, other numbers are possible, for example 9 pins, which are used when playing skittle also called 9-pin bowling.

FIG. 4 schematically shows a pulley 40 which is used in a pin-setting apparatus according to an embodiment. The pulley 40 comprises a substantially cylindrical wheel hub 41 having one spiralled groove for receiving a string, not shown in FIG. 4. The spiralled groove will help by winding up the string in an evenly distributed way over the total length of the wheel hub. At the outer ends of the wheel hub, the pulley 40 comprises two flanges 42, 43 to avoid the string from getting off of the pulley 40. The pulley further comprises an axis 44. Out of one end of the axis 44, an electrical wire leaves the pulley 40. The electrical wire 45 is connected to an electrical motor arranged inside the wheel hub 41. The electrical motor is arranged to rotate the wheel hub 44 relative to the axis 44 using techniques well known to the skilled person. The axis 44 will be mounted using connection means to the frame 20 shown in FIG. 2.

FIG. 5 schematically shows a further embodiment of the pulley, see pulley 50. Pulley 50 comprises a wheel hub 51 having two flanges 52, 53 and rotatable around an axis 54. An electrical motor 55 is co-axially arranged next to the wheel hub 51 and is connected to the axis 44 so as to activate the pulley 50.

A pulley 40; 50 can be rotated in two opposite directions by powering the motor in a suitable way. In a first direction, the pulley 40; 50 is used to roll up the associated string 3', 4', 5', 6'. The activating means, i.e. the motor, is controlled by a controller as will be explained with reference to FIG. 6.

FIG. 6 is a functional block diagram showing the main components of the pin-setting-apparatus according to an embodiment. In FIG. 6 only one pulley 60 is shown for reasons of simplicity. The pulley 60 comprises a controller 601, a motor controller 602, an electromotor 603 and a rotation detection unit 604. The rotation detection unit may comprise a wheel co-axially connected to the pulley and comprising peripheral wholes and a light pulse sensor for sensing light pulses created by the rotating wheel when lit by a light source. Furthermore, the pulley 60 comprises a linear actuator control 605, a linear actuator 606 and on "off spot" detection unit 607. The controller 601 of the pulley 60 is communicating with a central controller 61 via a communication line 65 such as a data bus 65. The central controller 61 is communicating to a score system 62 via a communication line 66, such as a RS-232/Ethernet line. Both the communication line 65 and 66 can be wired or wireless communication lines as will be appreciated by the skilled person.

The controller 601 is arranged to receive input from the rotation detection unit 604 and in this embodiment also from the off spot detection unit 607. The controller 601 may be a CPU having suitable memory, such as RAM. Once a rotation of the pulley 60 is detected, caused by increased tension in the associated string, the controller 601 will send an output to the motor controller 602 in order to activate the electromotor 603. In this case the motor is activated to unroll the string of the pulley 60. Preferably the string is unrolled at a speed of between 0.25 to 2 meters per second. These speeds result in an almost free movement of the pin involved. The pin will not be obstructed by the string since it is unrolled very fast. In fact, due to the invention, the pin will move/act as if it was not tied to a string.

In the event where a pin is hit but is still standing, but in a slightly changed position, that pin is "off spot". In such a situation, the "off spot" detection unit 607 will detect the off-spot of the associated pin and will send a signal to the controller 601 which will process this signal. The controller 601 will send a command to the linear actuator control 605 which will activate the linear actuator in such a way that the pulley 60 is repositioned above the "off spot" position. In an embodiment, each pulley is moved by two actuators to be able to move in two independent dimensions, named X and Y-direction. The plane X-Y determined by the X and Y direction may be in the horizontal plane, however it should be noted that other orientations are conceivable as long as the pins can be repositioned by moving the pulley.

FIG. 7 shows the central controller 61 connected to ten pulleys referred to as pulley 60-1 to 60-10. As already mentioned, the invention is not restricted to ten pins, other numbers are possible.

In an embodiment, the pulleys are mounted in the frame 20 in a replaceable manner. In this way, a malfunctioning pulley can easily be replaced which significantly reduces maintenance costs.

In an embodiment, the wheel hub 41;51 is made of nylon. Such a light material will make the total wheel hub very light weight which is preferable when aiming for fast response times. Fast response times are wanted when unrolling the string if a pin is hit.

The detection of the falling down of the pins may be realized using different techniques. In one embodiment, each pulley comprises a detecting means arranged to detect a slight rotation of the pulley. Once it is detected that the pulley has started to rotate, the pulley will be unrolled and the pin is registered to be a hit. This will then be communicated by the central controller 61 to the score system 62, see FIG. 6.

In the embodiment with a "off spot" detection unit, a pin that is hit but stills stands in an off spot position, is registered as being an off spot to the central controller which will sent a message to the score system 62 indicating that the pin is not a hit. However, the controller 601 of the pulley 60 will use the off spot information to reposition itself above the new position. In a particular embodiment, the off-spot detection unit comprises a CCD camera arranged above the pin. Alternatively, a single CCD scanner camera is mounted farther down the bowling lane. This camera is arranged to detect exactly which pins have been knocked down, and then relays this information to the pinsetter. In this embodiment only one CCD camera is needed instead of ten. It should further be mentioned that instead of a CCD camera, the positions of the pins can be detected using e.g. laser or an ultrasonic detection system.

Now a typical process of one bowling turn is described. This explanation starts when all ten pins are standing upright in their initial positions. A player will throw the ball and in this example hits six pins, five of them fall down and one is moved "off spot". Only the pulleys of the pins that are actually hit will unroll. According to the invention, the unrolling will be performed in an active way to minimize any influence the string has on the movement of the moving pin. In an embodiment, the strings are unrolled to the maximum length. A typical length of the strings varies between 3-4 m, but other lengths are possible. In an embodiment, in the initial position there is no tension in the strings. Preferably, the strings will have some play which is enough to let a pin move off spot without creating any tension in the string. Please note that that alternatively, the string could be unrolled actively even in the situation where the pin will 'just' move off spot.

Next, the pins hit are registered and also the off-spot position of the one pin is determined and stored in a memory of the controller 601 and/or of the central controller 61. Next all pins are pulled up by their corresponding pulleys. The pins will be pulled into their clocks. The clock and pulley of the off-spot pin will be repositioned using positioning means. Next, five of the pins will be put back on the deck 7 being the four unhit pins and the off-spot pin. The score system will show the result to the player and, if present, a blocking plate is removed to make the pin deck available for the next ball. The player will then throw the second ball and in this case hits the remaining pins which results in a "spare". The pulleys of these last five will unroll the strings as soon as a movement of the pins is detected. The pin-setting apparatus will roll up the strings of these five pins so that they will get docked in their clocks. Finally all ten pins will be positioned onto their default positions.

If the strings are entwined, when pulling up the pins, the pulleys concerned will detect this and will stop the rotation of the wheel hubs. The detection can for example be done by detecting an increase in electrical current going through the electro motors. If the electrical current exceeds a predefined threshold, the rotation of the pulley is stopped. In an embodiment, each pulley comprises a special break system. This break system will stop the rotation of the wheel hubs as soon as required. This may be when a pin has reached the top of its clock or when the strings are entwined and cannot reach their own clock.

According to an embodiment, the pin-setting apparatus is arranged to perform a special disentangle procedure. When detecting that some pins are blocked before reaching their clocks, all strings will be unrolled, and next all the pins will be pulled up. If the strings are still entwined only the even pins are lowered, and the uneven pins stay above. Next, the uneven pins are lowered. Preferably, the pins are not laid down as in the state of the art. The pulleys will unroll the string to a certain extent. The strings will be unrolled so that the pins will hang above the pin deck 7 and not touch the pin deck. If some strings are entangled, the freely hanging pins will rotate ('dance') in a suitable way. This will lead to the untangling of the strings much faster than when the pins are laid down and pulled up in their clocks for a couple of times. The reason is that in the state of the art the pins only have a limited time period to freely rotate/disentangle. That time period starts when the lying pins are picked up and do not touch the deck until they reach their corresponding clocks.

It is emphasized that the present invention can be varied in many ways, of which the alternative embodiments as presented are just a few examples. These different embodiments are hence non-limiting examples. The scope of the present invention, however, is only limited by the subsequently following claims.

The invention claimed is:

1. A pin-setting apparatus for bowling or skittle lanes, the apparatus comprising:

a plurality of pins, wherein each pin is connected to an associated string;

a plurality of rotatable pulleys, each of the plurality of rotatable pulleys being arranged to roll up and/or off an associated string of a corresponding one of the plurality of pins;

a plurality of detecting means, each of the plurality of detecting means being arranged to detect a movement of a corresponding one of the plurality of pins;

a plurality of electrical motors, each of the plurality of electrical motors being arranged to rotate a corresponding one of the plurality of pulleys, and a controller arranged to receive from each of the plurality of detecting means input relating to movement of a corresponding one of the plurality of pins and to control each of the plurality of electrical motors arranged to rotate a corresponding one of the plurality of pulleys in such a way that the corresponding pulley's associated string is actively rolled off as soon as the movement of the corresponding pin has been detected.

2. The pin-setting apparatus according to claim 1, wherein each of the plurality of rotatable pulleys comprises a corresponding wheel hub and wherein each of the plurality of electrical motors is arranged inside an associated pulley's corresponding wheel hub.

3. The pin-setting apparatus according to claim 1, wherein each of the plurality of rotatable pulleys comprises a corresponding wheel hub and a corresponding axis, and wherein each of the plurality of electrical motors has an axis that is coupled to an associated pulley's corresponding axis.

4. The pin-setting apparatus according to claim 1, wherein each of the plurality of detecting means comprises an electrical circuit arranged to detect an induction current caused by a rotation of an associated pulley.

5. The pin-setting apparatus according to claim 1, wherein the apparatus further comprises for each pin a corresponding positioning means arranged to move the pin's corresponding pulley above a determined pin position, so as to be able to reposition the pin in case of an off-spot situation.

6. The pin-setting apparatus according to claim 1, wherein each of the plurality of electrical motors is arranged to rotate a corresponding pulley to roll off the pulley's associated string with a speed of between 0.25-2 meters per second.

7. The pin-setting apparatus according to claim 1, wherein the controller is arranged to:

detect when some of the plurality of strings are entangled;

control electrical motors and pulleys corresponding to the entangled strings in such a way that pins corresponding to the entangled strings are each lowered to a position wherein the lowered pin does not touch a corresponding string guiding clock or a pin deck of the apparatus.

* * * * *